US005678573A

United States Patent [19]

Aldin, Sr.

[11] Patent Number: 5,678,573

[45] Date of Patent: Oct. 21, 1997

[54] SMOKING PIPE

[76] Inventor: Edward G. Aldin, Sr., 6491 Greenhill Rd., Lumberville, Pa. 18933

[21] Appl. No.: 372,981

[22] Filed: Jan. 17, 1995

[51] Int. Cl.[6] ..... A24F 5/00; A24F 5/04

[52] U.S. Cl. ..... 131/226

[58] Field of Search ..... 131/226, 227, 131/216; D27/163, 165–169

[56] References Cited

U.S. PATENT DOCUMENTS

| | | | |
|---|---|---|---|
| 254,114 | 2/1882 | Cole | 131/227 X |
| 2,441,715 | 5/1948 | Miller | 131/226 X |
| 2,709,441 | 5/1955 | Motsinger | 131/227 X |
| 4,210,160 | 7/1980 | Wunsche | 131/226 X |

FOREIGN PATENT DOCUMENTS

| | | | |
|---|---|---|---|
| 2035778 | 6/1980 | United Kingdom | 131/226 |

*Primary Examiner*—Jennifer Bahr

*Attorney, Agent, or Firm*—Robert M. Sperry

[57] ABSTRACT

An improved smoking pipe comprising a bowl having a central generally cylindrical bore open at both ends of said bowl with a closable lid mounted on the top of said bowl and a stem projecting from the wall of said bowl and communicating with said central bore of said bowl, which allows the smoker to light the bottom of the load of tobacco and creates a natural updraft through the burning tobacco to cause complete combustion of the entire load of tobacco without the necessity of frequent relighting and preventing the accumulation of moisture, tar and the like within the pipe bowl.

11 Claims, 2 Drawing Sheets

SMOKING PIPE

FIELD OF INVENTION

This invention relates to smoking pipes and is particularly directed to improved smoking pipes having a generally cylindrical bowl having a central bore open at both ends of said bowl with a closable lid mounted on the top of said bowl and a stem projecting from the wall of said bowl and communicating with said central bore of said bowl.

PRIOR ART

Smoking pipes have long been a popular way of smoking tobacco and usually comprise a generally cup-shaped bowl having a stem projecting from one side of the bowl and communicating with the central recess of the bowl to allow the user to draw air and smoke through the bowl and stem into the user's mouth. However, with prior art pipe designs, the fires sits on the top of the tobacco and the only air flow supporting the combustion is that produced when the smoker draws air through the stem. This produces inefficient burning and makes it necessary for the smoker to frequently relight the pipe in order to consume most of the tobacco in the pipe bowl. Furthermore, as the tobacco is burned, moisture is produced which accumulates in the bottom of the bowl, causing the portion of the tobacco in the bottom of the bowl to become soggy and producing a bitter and unpleasant taste. Consequently, this portion of the tobacco is usually wasted and must be discarded. Also, the pipe must be allowed to dry for a considerable time before reuse in order to avoid contamination of a new charge of tobacco. In view of this, it has been necessary heretofore, for a pipe smoker to own several pipes, so that they could have a fresh pipe available for smoking, while a previously smoked pipe was drying. However, acquiring a plurality of pipes is expensive and discarding of the moisture-soaked portion of each pipeload of tobacco is wasteful. Numerous prior art mechanisms have been proposed for overcoming these problems. Thus, various pipe structures have been proposed which were intended to provide ventilation to the lower bowl area to evaporate moisture. However, these prior art structures have been complex and expensive to produce and none have produced satisfactory results. A search in the United States Patent Office has revealed the following:

| U.S. PAT. NO. | INVENTOR | ISSUED |
|---|---|---|
| 4,020,853 | R. T. Nuttall | May 3, 1977 |
| 4,135,522 | D. E. Headricks | Jan. 23, 1979 |
| 3,645,274 | H. A. Lebert | Feb. 29, 1972 |
| 4,190,063 | D. R. Turner | Feb. 26, 1980 |
| 4,224,953 | S. Alvarez | Sep. 30, 1980 |
| 4,934,384 | F. Graham | Jun. 19, 1990 |
| 3,363,633 | C. J. Weber | Jan. 16, 1968 |
| 3,605,758 | J. K. Patterson | Sep. 20, 1971 |
| 4,478,228 | R. A. Chissster | Oct. 23, 1984 |
| Ger. 3115012A1 | A. G. Stewart et al | Oct. 28, 1982 |

Each of these references is subject to the disadvantages discussed above. Thus, none of the prior art smoking pipes have been entirely satisfactory.

BRIEF SUMMARY AND OBJECTS OF INVENTION

These disadvantages of the prior art are overcome with the present invention and an improved smoking pipe is provided which precludes accumulation of moisture, tar and the like at the bottom of the bowl and which avoids wasting of tobacco and the time required for drying a pipe, yet assures smooth and pleasant smoking of each entire charge of tobacco.

The advantages of the present invention are preferably attained by providing an improved smoking pipe having a bowl having a central generally cylindrical bore open at both ends of said bowl with a closable lid mounted on the top of said bowl and a stem projecting from the wall of said bowl and communicating with said central bore of said bowl, which allows the smoker to light the bottom of the load of tobacco and creates a natural updraft through the burning tobacco to cause complete combustion of the entire load of tobacco without the necessity of frequent relighting and preventing the accumulation of moisture, tar and the like within the pipe bowl.

Accordingly, it is an object of the present invention to provide an improved smoking pipe.

Another object of the present invention is to provide an improved smoking pipe which precludes accumulation of moisture, tar and the like at the bottom of the bowl.

An additional object of the present invention is to provide. an improved'smoking pipe which avoids wasting tobacco.

A further object of the present invention is to provide an improved smoking pipe which avoids the necessity of drying the pipe after each use.

Another object of the present invention is to provide an improved smoking pipe which allows the smoker to light the bottom of the load of tobacco.

An additional object of the present invention is to provide an improved smoking pipe which creates a natural updraft through the burning tobacco.

A further object of the present invention is to provide an improved smoking pipe which causes complete combustion of the entire load of tobacco.

An additional object of the present invention is to provide an improved smoking pipe which avoids the necessity of frequent relighting.

Another object of the present invention is to provide an improved smoking pipe which prevents the accumulation of moisture, tar and the like within the pipe bowl.

A specific object of the present invention is to provide an improved smoking pipe comprising a bowl having a central generally cylindrical bore open at both ends of said bowl with a closable lid mounted on the top of said bowl and a stem projecting from the wall of said bowl and communicating with said central bore of said bowl, which allows the smoker to light the bottom of the load of tobacco and creates a natural updraft through the burning tobacco to cause complete combustion of the entire load of tobacco without the necessity of frequent relighting and preventing the accumulation of moisture, tar and the like within the pipe bowl.

These and other objects and features of the present invention will be apparent from the following detailed description, taken with reference to the figures of the accompanying drawing.

DETAILED DESCRIPTION OF THE INVENTION

Figure 1:
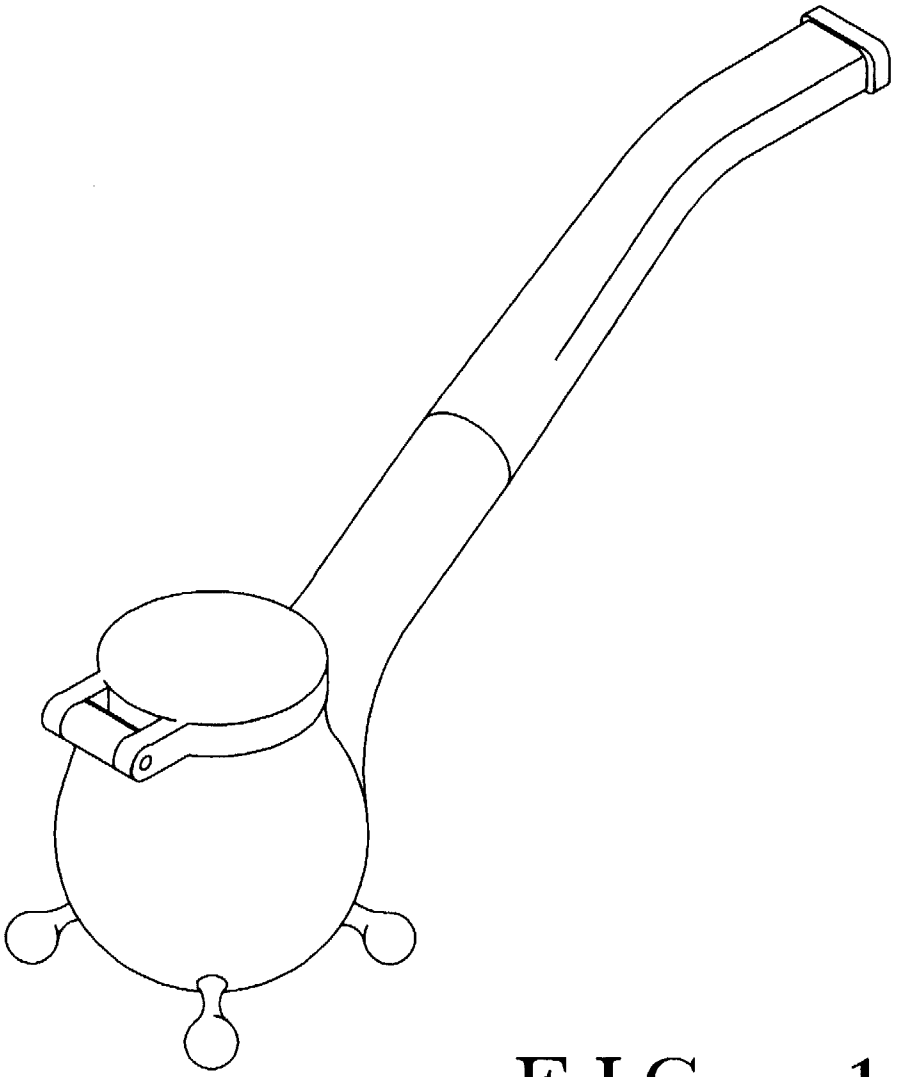
FIG. 1 is an isometric view of a smoking pipe embodying the present invention.
Figures 2, 3, 4, 5:
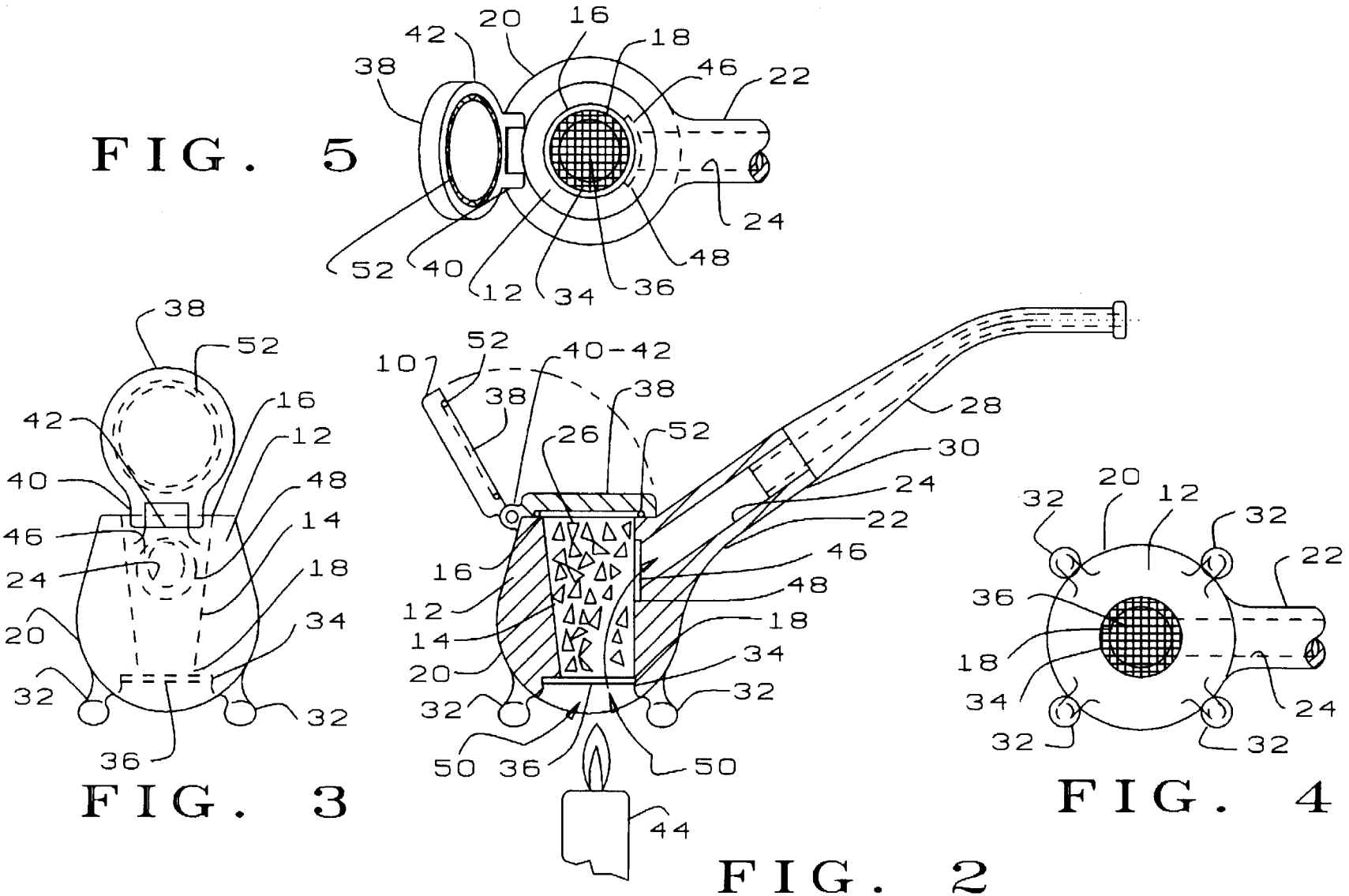
FIG. 2 is a vertical section through the smoking pipe of FIG. 1.
FIG. 3 is a front view of the bowl of the pipe of FIG. 1.
FIG. 4 is a bottom view of the pipe of FIG. 1.
FIG. 5 is a top view of the pipe of FIG. 1, shown with the lid in the raised position, with the tobacco omitted for clarity.

In that form of the present invention chosen for purposes of illustration in the drawing, FIG. 1 shows a smoking pipe, indicated generally at 10, having a bowl 12 formed with a generally cylindrical central bore 14 extending vertically through the bowl 12 and having open upper and lower ends 16 and 18, respectively. A stem 22 projects from one side of the bowl 12 and has a central bore 24 which communicates with the bore 14 of the bowl 12 to allow the user to draw smoke and air through a charge of tobacco, indicated at 26, located within the bore 14 of the bowl and a mouthpiece 28 may be mounted on the outer end 30 of the stem 22, as best seen in FIG. 1. As is well known in the pipe art, the bowl 12 may be formed of suitable material, such as corn cob, briar, clay, metal or the like and the external surface 20 of the bowl 12 may be configured substantially as desired. As best seen in FIGS. 1, 2 and 3, the central bore 14 of the bowl 12 tapers inwardly slightly from top to bottom to facilitate loading and tamping of the charge 26 of tobacco. The bowl 12 is preferably provided with feet 32 and, if desired, recesses 34 may be provided adjacent the feet 32 to allow insertion and removal of a mesh slide 36 to extend across the lower end 18 of the bore 14 of the bowl 12. Finally, a solid lid 38 is mounted adjacent the upper end 16 of the bore 14 of the bowl 12. As shown, the lid 38 is hingedly mounted, as seen at 40, with a hinge 42 which may be part of the bowl 12 and is the lid 38 is closably seated on the bowl 12 by suitable latching means 52 or by the weight of the lid 38. The lid 38 is movable between an open position, as seen in dashed lines in FIG. 2, and a closed position, wherein the lid 38 closes the upper end 16 of the bore 14 of bowl 12, as seen in solid lines in FIG. 2. The lid 38 is held in the closed position by latch 52 or by the weight of the lid 38.

In use, the smoker raises the lid 38 to the open position and loads and tamps the charge 26 of tobacco into the bore 14 of the bowl 12. If the mesh slide 36 is not provided, the smoker may use a thumb to close the lower end 18 of bore 14, while the charge 26 of tobacco is loaded and tamped. Once the charge 26 of tobacco has been loaded and tamped into the bore 14, the charge 26 of tobacco will be frictionally retained in the bore 14 and by the mesh slide 36. Thus, closing of the lower end 18 of bore 14 is no longer necessary. Next, the smoker closes the lid 38 to prevent undesired airflow through the upper end 16 of the bore 14 and lights the pipe 10 by igniting the charge 26 of tobacco through the lower end 18 of bore 14, as indicated by the lighter 44 in FIG. 2, and drawing through the mouthpiece 28, bore 24 of the stem 22 and through the charge 26 of tobacco contained in the bore 14. Also, since the charge 26 of tobacco is ignited adjacent the open lower end 18 of bore 14, a natural updraft will occur through the charge 36 of tobacco which will support complete combustion of the charge 36 of tobacco. Thereafter, the smoker procedes to smoke the pipe 10 in the usual manner. Should the smoker desire to set the pipe 10 on a surface, such as a table or the like, the legs 32 elevate the bowl 12 above the surface a sufficient distance to prevent the heat of the burning charge 26 of tobacco from burning the surface and allows airflow through the space between the surface and the lower end 18 of the bore 14 to support continued burning of the charge 26 of tobacco. When the smoker has finished smoking the charge 26 of tobacco, he raises the lid 38 to the open position and taps the pipe 10 against his hand to allow the ashes of the charge 26 of tobacco to be discharged from the bore 14.

Obvoiusly, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A smoking pipe comprising:

a bowl having a central generally cylindrical bore extending vertically through said bowl and open at both the upper and lower ends of said bowl to provide unobstructed vertical air flow through said bore with a stem projecting from the wall of said bowl and communicating with said bore.

2. The smoking pipe of claim 1 further comprising:

a lid mounted on the top of said bowl and movable between a closed position covering said bore and an open position.

3. The smoking pipe of claim 1 further comprising:

a plurality of feet projecting from the lower end of said bowl and serving to support said bowl when said pipe is set on a surface.

4. The smoking pipe of claim 3 wherein:

said feet serve to support said bowl a sufficient distance above said surface to prevent burning of said surface.

5. The smoking pipe of claim 3 wherein:

said feet serve to suppgrt said bowl a sufficient distance above said surface to allow airflow between said feet to support combustion within said bore.

6. The smoking pipe of claim 3 further comprising:

recesses formed adjacent the lower open end of said bore, and a mesh member movable into and out of said recesses to releasably cover said lower end of said bore.

7. The smoking pipe of claim 1 further comprising:

a mesh member movable into and out of a position to cover the lower open end of said bore.

8. The smoking pipe of claim 2 wherein:

said lid is operable in said closed position to prevent undesired airflow through the upper end of said bore.

9. The smoking pipe of claim 1 wherein:

said bore is tapered inwardly from top to bottom.

10. The smoking pipe of claim 2 wherein:

an updraft is created through said bore when said lid is closed and a charge of tobacco in said bore is ignited.

11. The smoking pipe of claim 10 wherein:

said updraft supports continuous and complete combustion of said charge of tobacco.

* * * * *